United States Patent [19]

McKay

[11] 4,104,018

[45] Aug. 1, 1978

[54] COMBUSTER

[75] Inventor: Richard A. McKay, Pasadena, Calif.

[73] Assignee: The United States of America as represented by the Administrator of the National Aeronautics and Space Administration, Washington, D.C.

[21] Appl. No.: 745,384

[22] Filed: Nov. 26, 1976

[51] Int. Cl.[2] ..... F24H 1/36; F24H 1/00

[52] U.S. Cl. ..... 432/29; 126/91 A; 431/10; 431/208; 432/223

[58] Field of Search ..... 432/29, 219, 223; 126/91 A; 431/208, 10; 60/39.71, 39.18 B, 39.51 R; 110/1 J

[56] References Cited

U.S. PATENT DOCUMENTS

| | | | |
|---|---|---|---|
| 3,393,690 | 7/1968 | Chu et al. | 432/29 |
| 3,709,473 | 1/1973 | Ito et al. | 432/219 |
| 3,826,079 | 7/1974 | Quigg et al. | 60/39.51 R |
| 4,012,904 | 3/1977 | Nogle | 60/39.71 |

*Primary Examiner*—John J. Camby

*Attorney, Agent, or Firm*—Monte F. Mott; John R. Manning; Wilfred Grifka

[57] ABSTRACT

A combuster is provided for utilizing a combustible mixture containing fuel and air, to heat a load fluid such as water or air, in a manner that minimizes the formation of nitrogen oxide. The combustible mixture passes through a small diameter tube where the mixture is heated to its combustion temperature, while the load fluid flows past the outside of the tube to receive heat. The tube is of a diameter small enough that the combustible mixture cannot form a flame, and yet is not subject to wall quench, so that combustion occurs, but at a temperature less than under free flame conditions. Most of the heat required for heating the combustible mixture to its combustion temperature, is obtained from heat flow through the walls of the pipe to the mixture.

10 Claims, 6 Drawing Figures

COMBUSTER

ORIGIN OF INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to combustors and combustion methods, and especially to devices for utilizing fuel and air to heat a load fluid such as water or air.

Combustors utilized to heat a load fluid, such as in utility boilers or for water or space heaters, typically generate a flame which produces hot combustion product gases that flow over tubes containing the load fluid which is to be heated. Where the fuel is burned with air, which contains nitrogen, the high temperature of the flame produces nitrogen oxide which contributes to pollution of the atmosphere. A combustor which could combust a fuel and air at a lower temperature than exists under free flame conditions, and which could produce substantially complete combustion of the fuel, could provide practical heating systems which minimize pollution.

SUMMARY OF THE INVENTION

In accordance with one embodiment of the present invention, a combustion system is provided which combusts fuel and air at lower temperatures than heretofore, to minimize the generation of nitrogen oxide in the exhaust, and which provides substantially complete combustion and a high degree of heat transfer to a load fluid which is to be heated. The combustor includes tubes or other conduits of small internal width, a pump for moving a combustible mixture through the inside of the conduit, and means for moving a load fluid over the outside of the conduit. The conduit has a pre-combustion zone where the combustible mixture is heated to a combustion temperature, a combustion zone along which combustion occurs, and a post-combustion zone, along which the hot combustion gases move. Under steady state condition, heat generated in the combustion zone travels through the thick walls of the conduit into the pre-combustion zone to heat the combustible mixture to the combustion temperature. The inside width of the conduit is normally less than 10 millimeters, to cause combustion in a condition below free flame.

The novel features of the invention are set forth with particularity in the appended claims. The invention will be best understood from the following description when read in conjunction with the accompanying drawings.

DESCRIPTION OF THE PREFERRED EMBODIMENT

Figures 1, 2, 3:
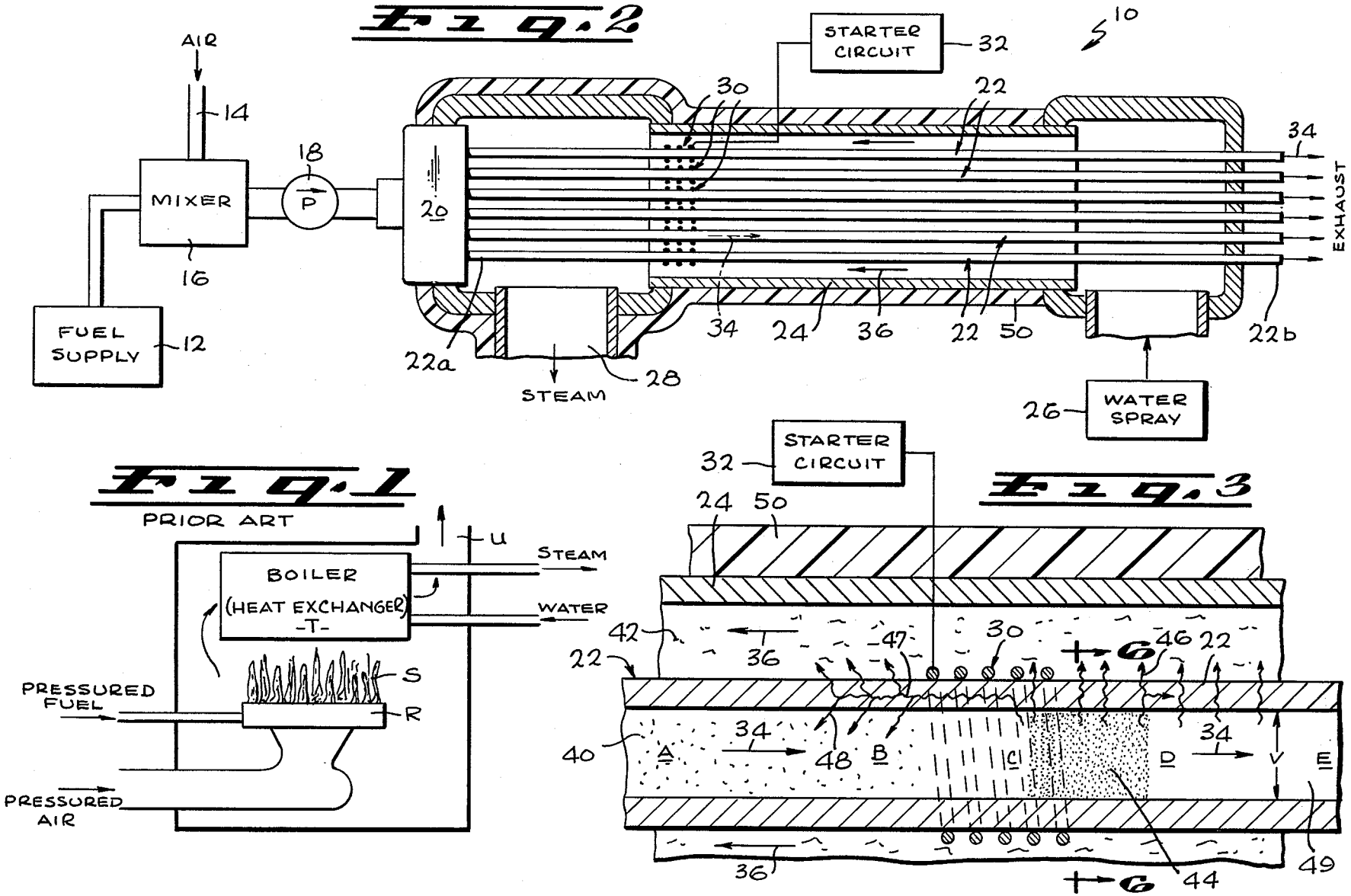
FIG. 1 is a simplified view of a prior art combustion system.
FIG. 2 is a partially sectional side view of a combustion system constructed in accordance with the present invention.
FIG. 3 is a sectional view of a portion of the system of FIG. 2, with the vertical dimension exaggerated with respect to the horizontal dimension.

FIG. 1 is a simplified view of a prior art heating system wherein fuel and air are mixed in a combustor R to produce a free flame S that generates hot combustion products. The combustion products pass through a boiler or heat exchanger T, over the multiple tubes thereof which carry water, to turn water in the boiler into steam. The cooled exhaust passes out through an exit U. The exhaust contains substantial amounts of nitrogen oxide because, for a hydrocarbon fuel, the free flame at S has a high temperature such as 3600° F which promotes the production of nitrogen oxide. Significant amounts of nitrogen oxide are generated at temperatures above about 2800° F.

FIG. 2 illustrates a heating system 10 of the present invention, wherein fuel from a fuel supply 12 is mixed with air from an input 14 in a mixer 16. The fuel-air mixture, or combustible medium, is then pumped by a pump 18 into a manifold 20. A plurality of combustor conduits 22 are positioned with one end **22*a* of each conduit coupled to the manifold to receive the combustible mixture therefrom, and with an opposite end 22*b* which leads to the atmosphere to exhaust combustion products thereto. The conduits or tubes 22 extend through a duct 24, with a first end of the duct coupled to a water spray 26 where water droplets are injected into the duct and with a second end coupled to a stream outlet 28** where steam is delivered, as for space heating or operation of a turbine.

A group of starters 30 are positioned along each of the combustor tubes 22 to heat a tube portion at start-up of the system, to begin the combustion of the fuel/air mixture in the tubes. The starters 30 are electrical heating elements which are supplied with currents from a starter circuit 32 to heat the corresponding tube portions. As the fuel/air mixture moves through the tubes in the direction of arrow 34, the mixture is heated to a combustion temperature at which the fuel/air mixture combusts to produce heat. The heat is utilized to heat the water droplet/load fluid, which is passing in the direction of arrow 36 through the duct 24, to turn the droplets into steam. The heat of combustion is also utilized to heat the fuel/air mixture to a combustion temperature so that it will combust.

FIG. 3 is an illustration of one of the tubes 22, but with the vertical dimension of the drawing being exaggerated. The fuel/air mixture 40 enters the tube near the point A, where the mixture is at substantially ambient temperature. As the fuel/air mixture moves in the direction of arrow 34, during steady-state operation of the system, the temperature of the mixture increases because of its intimate contact with the inner surface of the wall of the tube 22. Some heat is, of course, transferred to the mixture by radiation from the tube walls and combusting gas. The tube wall has been heated by reason of the inflow of heat from hot load fluid 42 outside of the tube, and by reason of heat traveling lengthwise along the tube from a combustion zone located downpath from the point A. By the time the fuel/air combustible mixture has reached the point B, it will have been heated to about 1200° F, which is about half of the temperature gain from ambient required for combustion of a hydrocarbon fuel in air. By the time the mixture reaches the point C, it will have attained a temperature of about 2200° F at which combustion occurs. Between the locations C and D, combustion continues until substantially complete combustion has occurred. Between the points D and E, the combustion products are cooled as they transfer heat through the walls of the tube 22 to the load fluid 42.

The inside diameter V of the tube is relatively small, such as 2 millimeters, to prevent combustion under free flame conditions. The small diameter or width of the tube results in such closeness of the walls to the combusting mixture, that heat is transferred out of the combustion zone at a rate that prevents the combustion temperature from becoming as high as it does in free flame condition. Instead, combustion takes place along a relatively lengthy combustion zone 44 extending between points C and D, with the maximum combustion temperature being less than is encountered under free flame conditions. The result of this is that the nitrogen which is contained in the combustible mixture, forms a minimal amount of nitrogen oxide which will pollute the atmosphere. The desired range of temperature for the combustion of hydrocarbon fuels with air is 2200°–2800° F. This temperature range is high enough to assure complete combustion of the fuel, but is not high enough for significant oxidation of nitrogen to form nitrogen oxide.

In tubes of an inner diameter much larger than 10 millimeters carrying a combustible mixture, the velocity with which a flame can propagate down the tube is a function of the tube diameter. As the diameter of the tube is reduced below a critical diameter, the flame propagation velocity will be reduced due to wall quenching, that is, due to the transference of heat out of the combustion zone at a rate equal to the generation of heat by the flame. As the tube diameter is reduced still further, a diameter is reached for which the flame velocity is zero. This is the quenching diameter. At tube diameters below the quenching diameter, stable combustion can be carried out within a tube for gas velocities well above the atmospheric flame velocity, if the tube is first heated above a threshhold temperature to begin the combustion.

Figure 6:
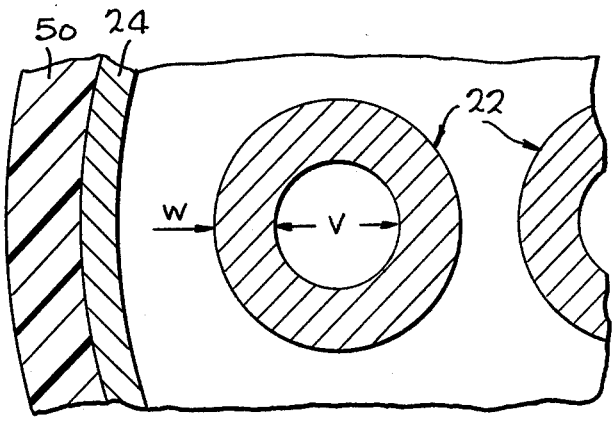
FIG. 6 is a view taken on the line 6-6 of FIG. 3.

As shown in FIG. 3, heat generated in the combustion zone 44 which extends between points C and D, passes along the paths indicated by the wavy lines, such as 46, 47 and 48. Most of the generated heat passes through the walls of the tube 22 along the combustion zone 44 downpath therefrom along a transfer conduit portion 49 extending between points D and E, to heat the load fluid 42. Additional heat passes along the paths indicated by arrows 47 and 48 to heat the fuel/air mixture which is approaching the combustion zone. Under stable conditions, the heat transferred along the paths 47, 48 into the fuel/air mixture, produces most of the heat which heats the mixture between a few hundred degrees Fahrenheit and the combustion temperature, and supplies a very high proportion of the heat which heats the mixture from 1200° F (½ of the rise in temperature from ambient to combustion) to the combustion temperature of about 2200° F. To this end, the walls of the tube 22 are preferably made thick. As illustrated in FIG. 6, the thickness W of the tube wall is on the order of magnitude of the radius of the inside of the tube, or ½ of the inside diameter V. Also, the tube 22 is constructed of a highly thermally conductive material, such as stainless steel, to conduct heat well along its length. Were it desired merely to conduct heat from the inside of the tube to the outside, much thinner walls would be utilized, such as with the wall thickness much less than one-fifth the radius of the tube, than are preferably utilized in the system of the present invention, at least along the region near the point C at the beginning of the combustion zone. The duct 24 can be made of any suitable confining material, such as steel, and is normally covered by an insulation covering 50. The tube of FIG. 3 can be formed with an inside diameter of about 2 millimeters and a length between points A and D of about one-half of a meter.

Figure 4:
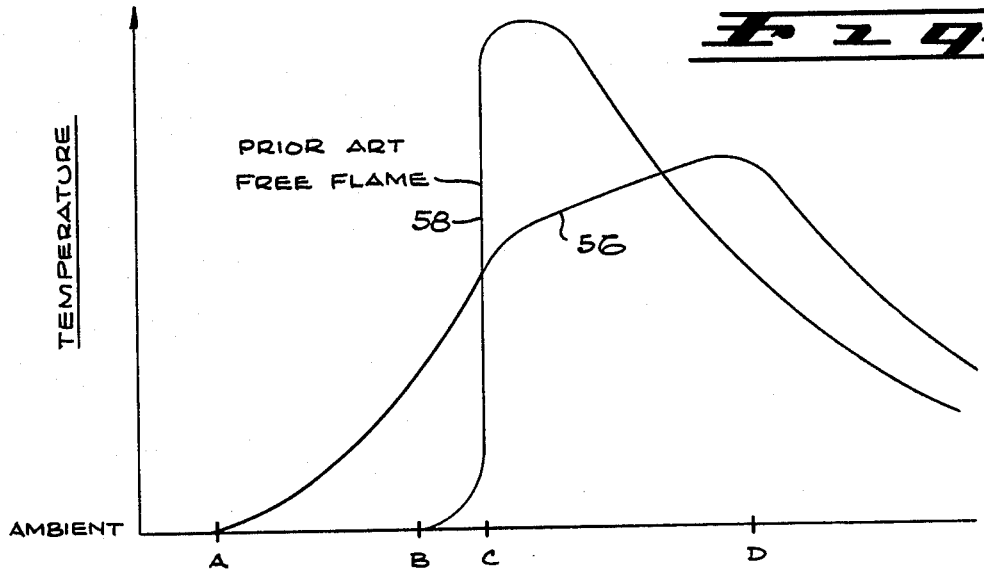
FIG. 4 is a graph comparing the variations in temperature of a combustible medium in the system of the present invention and in a system of the prior art.
Figure 5:
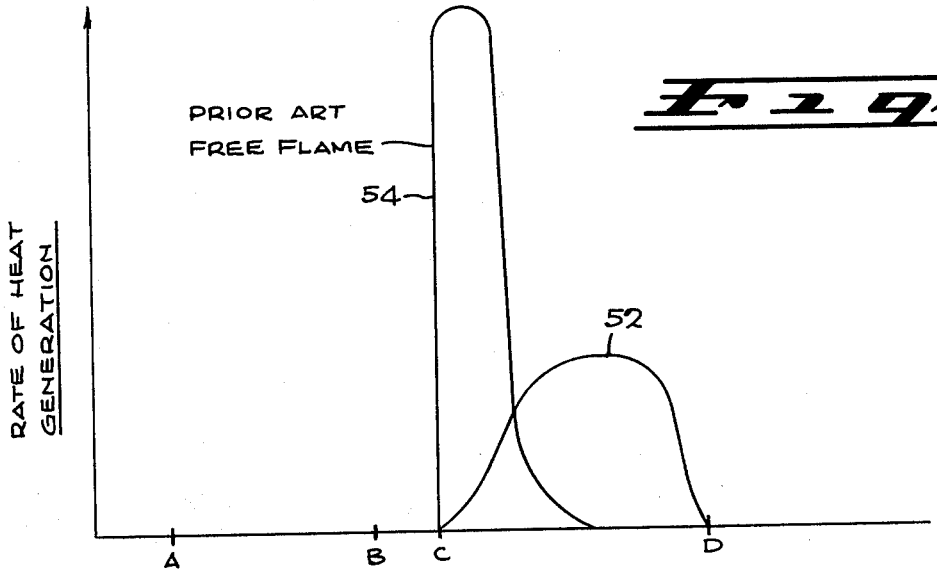
FIG. 5 is a graph comparing the variation and heat generation of the combustible medium in the system of the present invention and in the system of the prior art.

FIG. 5 indicates the rate of heat generation by the combusting fuel/air mixture as a function of position, with graph 52 representing combustion under the flameless conditions of the present invention, and graph 54 representing combustion under free flame conditions which occurs in the prior art system of FIG. 1. The graph 52 which represents the present system, can be seen to provide a lower rate of heat generation, but with the heat generation continuing over a longer distance. FIG. 4 indicates the variation in temperature of the combustible mixture with position, with graph 56 representing the temperature profile in the system of the present invention and graph 58 representing prior art free flame conditions that would occur in the system of FIG. 1. It can be seen that the free flame condition of graph 58 results in a higher temperature than is produced with applicant's flameless combustion, so that applicant's method will generate much less nitrogen oxide.

The starter circuit 32 and starters 30 are provided to initiate operation of the system. Each of the starters 30 comprises a heating element, such as a coil of resistance wire, which heats the wall of the tube 22 until combustion of the fuel/air mixture occurs and the tube becomes sufficiently heated to continue a stabilized combustion. A variety of heating schemes can be utilized, such as sparks, glow plugs, catalysts, and so forth. Also, a variety of combustible mixtures can be utilized, such as natural gas, hydrogen, vaporized petroleum, or pulverized solid such as coal. The conduit through which the fuel/air combustible mixture moves does not have to be a cylindrical tube, but may be formed by a pair of plates or a tube of any inside shape. In any case, however, the width, or smallest inside dimension, should be small enough to prevent free flame combustion. In the case of a pair of plates serving as a conduit, a plate separation of somewhat less than 2 millimeters would typically be desirable for hydrocarbon fuels, where if a tube were used the diameter would be about 2 millimeters. A conduit with very small inside diameter, such as porous plug, can be utilized, but this would result in a small flow rate of the combustible mixture. A ceramic conduit could be used instead of a metal one, but this would require a small wall thickness to transfer considerable heat to a load fluid. It is possible to have the combustible mixture travel in opposite directions through adjacent tubes, so the combustion and post combustion zones of one tube heat a precombustion zone of another tube by radiation or through a conducting fin that connects the tubes.

The conduit used depends to some extent upon the velocity of the combustible medium, the particular combustible medium, and the conductivity and thickness of the conduit walls. However, under most conditions, a inside conduit width on the order of magnitude of 2 millimeters can be utilized. The velocity of the combustible mixture is chosen so that the zone 44 is maintained in a stable condition. A velocity which is too high will cause the combustion zone to move downpath along the tube, while a velocity too low may cause the combustion zone to move up-path or even cause termination of combustion. A combustible mixture velocity on the order of magnitude of 300 centimeters per second through a tube with an inside diameter on the order of magnitude of 2 millimeters can maintain a stable combustion zone. In one experiment, a hydrocarbon-air mixture was passed through a tube of Inconel 600 of 2 millimeter inside diameter, at a volume flow of 10 cubic centimeters per second, and therefore a velocity of 320 centimeters per second, while maintaining combustion of the mixture.

Thus, the invention provides an apparatus and method for combusting a combustible mixture in a manner than minimizes the maximum temperature, and which is especially useful where air is utilized so that lowering of the combustion temperature minimizes the production of nitrogen oxide. Combustion is carried out by passing a combustible mixture through a small diameter tube, with the tube having a hot combustion zone where the mixture combusts under conditions below free flame. The walls of the tube are preferably of highly thermally conductive material and are preferably thick near the beginning of the combustion zone, so that heat generated in the combustion zone passes rearwardly along the tube wall, to heat the mixture which is approaching the combustion zone to a combustion temperature.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. Apparatus for utilizing a combustible medium to heat a load fluid, comprising:

a conduit;

means for pumping a combustible medium through said conduit;

means for initially combusting said medium, located along said conduit, for initially combusting said medium while it flows through said conduit; and means for flowing said load fluid against the outside surface of said conduit, along at least conduit locations wherein combustion is occurring, to permit the heating of said load fluid;

said conduit having an inside width which can maintain combustion of said combustible medium at a temperature below free flame.

2. The apparatus described in claim 1 wherein:

said conduit has a combustion zone where combustion of said medium occurs, and a preheat zone located up-path from said combustion zone and along which said medium is heated to its combustion temperature, said conduit having sufficiently thick walls between and along at least a portion of each zone, to supply most of the heat to said medium which raises its temperature between 1200° F and its combustion temperature during passage of said medium along said preheat zone.

3. The apparatus described in claim 1 wherein:

said conduit is a tube having a bore width of less than 10 millimeters.

4. The apparatus described in claim 1 wherein:

said conduit is constructed of highly thermally conductive material.

5. Apparatus for utilizing a combustible medium to heat a load fluid, comprising:

inner and outer conduits, said inner conduit lying within said outer conduit;

means for moving said combustible medium in a first direction through said inner conduit, and said inner conduit having a region in which combustion occurs; and means for moving a load fluid in a second direction opposite to said first direction, through said outer conduit past said region at which combustion occurs;

said inner conduit having an inside diameter which prevents free flame combustion of said combustible medium.

6. The apparatus described in claim 5 wherein;

said inner conduit is of substantially circular shape and has an inside diameter on the order of magnitude of 2 millimeters.

7. A method for heating a load fluid comprising:

passing a combustible medium which includes air, through a conduit that has highly thermally conductive walls, while heating said medium sufficiently to cause combustion of said medium along a predetermined combustion zone portion of said conduit, and flowing the products of said combustion along a transfer conduit portion extending downpath from said combustion zone portion; of and flowing a load fluid past the outer surface of said conductive walls at said transfer portion and said combustion zone portion of said conduit;

said combustion being maintained at a temperature below that of free flame, along said combustion zone, whereby to minimize the generation of nitrogen oxide.

8. The method described in claim 7 wherein:

said step of heating said medium includes conducting heat along walls of said conduit in a direction opposite to the flow direction of said medium therealong, in a quantity that supplies most of the heat which raises the temperature of said medium between 1200° F and the combustion temperature of the medium.

9. The method described in claim 7 wherein:

said conduit has a substantially circular inside of a diameter on the order of two millimeters, and an outside approximately twice the inside diameter; and said combustible medium flows at a velocity on the order of magnitude of 300 centimeters per second along said tube.

10. Apparatus for utilizing a fuel to heat a load fluid comprising:

an inner tube having an inside diameter less than 10 millimeters, and constructed of highly thermally conductive material with its inner and outer surfaces devoid of thermal insulation;

an outer tube surrounding said inner tube to leave a space between them;

means for mixing said fuel with air to form a combustible medium, and for pumping said combustible medium in a first direction through said inner conduit at a velocity on the order of magnitude of 300 centimeters per second;

means for moving said load fluid in a second direction opposite to said first direction through said outer tube;

means for initially heating said combustible medium at a predetermined location along said inner tube to a temperature at which it combusts;

said inner tube having a wall thickness more than one-fifth the radius of the inside of said tube, whereby to conduct heat in said second direction along the walls of the inner tube to heat the combustible mixture to its combustion temperature.

* * * * *